US011717125B2

(12) United States Patent
Tang et al.

(10) Patent No.: US 11,717,125 B2
(45) Date of Patent: Aug. 8, 2023

(54) PARTITION SKIRT DEVICE AND CLEANING APPARATUS

(71) Applicants: Beijing Shunzao Technology Co., Ltd., Beijing (CN); BEIJING XIAOMI MOBILE SOFTWARE CO., LTD., Beijing (CN)

(72) Inventors: Cheng Tang, Beijing (CN); Fei Duan, Beijing (CN); Liang Zhong, Beijing (CN); Chongyue Xu, Beijing (CN); Peiheng Zhu, Beijing (CN); Lu Han, Beijing (CN)

(73) Assignees: BEIJING SHUNZAO TECHNOLOGY CO., LTD., Beijing (CN); BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 17/563,362

(22) Filed: Dec. 28, 2021

(65) Prior Publication Data

US 2022/0369879 A1 Nov. 24, 2022

(30) Foreign Application Priority Data

May 20, 2021 (CN) ..... 202121090935.5

(51) Int. Cl.
*A47L 9/16* (2006.01)
*A47L 5/24* (2006.01)
*B04C 3/00* (2006.01)

(52) U.S. Cl.
CPC ..... *A47L 9/1608* (2013.01); *A47L 5/24* (2013.01); *A47L 9/1683* (2013.01); *B04C 3/00* (2013.01)

(58) Field of Classification Search
CPC ..... A47L 9/1608; A47L 9/1683; A47L 5/24; A47L 9/106; A47L 9/20; A47L 9/322; B01D 45/08; B01D 45/10
(Continued)

(56) References Cited

U.S. PATENT DOCUMENTS

2012/0148332 A1* 6/2012 Stredak ..... A45D 40/267 401/292
2019/0200824 A1* 7/2019 Campbell-Hill ..... A47L 9/1608
(Continued)

FOREIGN PATENT DOCUMENTS

CN 108814420 A 11/2018
CN 110786778 A 2/2020
(Continued)

OTHER PUBLICATIONS

Japanese Patent Application No. 2021-211891, Office Action dated Nov. 4, 2022, 4 pages.
(Continued)

*Primary Examiner* — Brian D Keller
*Assistant Examiner* — Tim Brady
(74) *Attorney, Agent, or Firm* — Cozen O'Connor

(57) ABSTRACT

A partition skirt device for a cleaning apparatus includes an inner ring and a skirt body. The skirt body includes: a root connected to the inner ring; an edge part arranged at an end of the skirt body away from the inner ring; and a plurality of collapsing parts arranged at intervals between the root and the edge part along a circumferential direction of the skirt body, and each extending along a radial direction of the skirt body. Along a thickness direction of the skirt body, the collapsing part protrudes relative to the skirt body on a first side surface of the skirt body and is recessed relative to the skirt body on a second side surface of the skirt body. On the first side surface of the skirt body, a size of a portion of the
(Continued)

collapsing part protruding from the skirt body gradually decreases from the root to the edge part.

20 Claims, 5 Drawing Sheets

(58) Field of Classification Search
USPC ..... 15/352, 359
See application file for complete search history.

(56) References Cited

U.S. PATENT DOCUMENTS

| | | | | |
|---|---|---|---|---|
| 2019/0200825 | A1* | 7/2019 | Crouch | A47L 9/165 |
| 2019/0200827 | A1* | 7/2019 | Crouch | A47L 9/322 |
| 2019/0200830 | A1* | 7/2019 | Crouch | A47L 9/0693 |
| 2022/0047132 | A1* | 2/2022 | Lee | A47L 9/127 |

FOREIGN PATENT DOCUMENTS

| | | | |
|---|---|---|---|
| CN | 112545359 | A | 3/2021 |
| CN | 112603193 | A | 4/2021 |
| JP | 2006020833 | A | 1/2006 |
| JP | 20060204882 | A | 8/2006 |
| JP | 2019118816 | A | 7/2019 |

OTHER PUBLICATIONS

Japanese Patent Application No. 2021-211891, English translation of Office Action dated Nov. 4, 2022, 4 pages.
Indian Patent Application No. 202144062204, Office Action dated Nov. 28, 2022, 6 pages.

* cited by examiner

PARTITION SKIRT DEVICE AND CLEANING APPARATUS

CROSS-REFERENCE TO RELATED APPLICATION

The present disclosure is based on and claims priority to Chinese Patent Application No. 202121090935.5, filed on May 20, 2021, the entire content of which is incorporated herein by reference.

TECHNICAL FIELD

The present disclosure relates to a field of cleaning apparatus, and more particularly to a partition skirt device for a vacuum.

BACKGROUND

In a cleaning apparatus, a hand-held cleaning apparatus such as a vacuum is often used for household cleaning by a user. The hand-held cleaning apparatus has a cyclone separation unit arranged in a dust cup.

Currently, during the use of the cleaning apparatus, the dust cup is often used as an outer wall of the cyclone separation unit to separate dirt, and the space between the dust cup and the cyclone separation unit is used as a separation chamber. The separation chamber includes a cyclone separation section located at one end of the dust cup and a dirt collection section located at the other end of the dust cup. The dirt is separated by an airflow at the cyclone separation unit, and the airflow flows around the separation chamber. The separated clean air passes through a filter screen of the cyclone separation unit for a next separation. However, since the air flows around an inner side of the separation chamber, the dirt that has been previously separated from the airflow is merged back into the airflow. In order to avoid the mutual influence of the cyclone separation section and the dirt collection section and to improve the dust and gas separation efficiency of the cyclone separation unit, a partition skirt is usually arranged between the cyclone separation section and the dirt collection section.

SUMMARY

Embodiments of an aspect of the present disclosure provide a partition skirt device configured to be mounted in a cyclone separation unit of a cleaning apparatus. The partition skirt device has an annular structure, and the partition skirt device includes an annular inner ring and an annular skirt body. The skirt body has a root connected to the inner ring and an edge part arranged at an end of the skirt body away from the inner ring. A diameter of the edge part is larger than a diameter of the root. The skirt body further includes a plurality of collapsing parts arranged at intervals between the root and the edge part along a circumferential direction of the skirt body, and the collapsing part is configured as a long strip structure extending along a radial direction of the skirt body. Along a thickness direction of the skirt body, the collapsing part protrudes relative to the skirt body on a first side surface of the skirt body, and is recessed relative to the skirt body on a second side surface of the skirt body. On the first side surface of the skirt body, a size of a portion of the collapsing part protruding from the skirt body gradually decreases from the root to the edge part.

Embodiments of another aspect of the present disclosure provide a cleaning apparatus, including a gun-type main body, a main machine mounted on the main body, a dust cup arranged on the main body, a removable cyclone separation unit arranged in the dust cup, and a partition skirt device. The dust cup has an opening part, and the opening part of the dust cup is connected with the main machine through an engaging structure. The partition skirt device is connected with the cyclone separation unit. The partition skirt device includes an annular inner ring and an annular skirt body. The skirt body has a root connected to the inner ring and an edge part arranged at an end of the skirt body away from the inner ring. A diameter of the edge part is larger than a diameter of the root. The skirt body further includes a plurality of collapsing parts arranged at intervals between the root and the edge part along a circumferential direction of the skirt body, and the collapsing part is configured as a long strip structure extending along a radial direction of the skirt body. Along a thickness direction of the skirt body, the collapsing part protrudes relative to the skirt body on a first side surface of the skirt body, and is recessed relative to the skirt body on a second side surface of the skirt body. On the first side surface of the skirt body, a size of a portion of the collapsing part protruding from the skirt body gradually decreases from the root to the edge part.

DETAILED DESCRIPTION

In order to better explain the present disclosure and facilitate understanding, the present disclosure will be described in detail below with reference to the accompanying drawings and through specific embodiments. The orientation terms such as "upper", "lower", "left" and "right" mentioned herein are based on the orientation of FIG. 1. A side where a main body 80 is located is defined as a "lower" part, and another side where a dust cup 20 and a main machine 60 are located is defined as an "upper" part.

Inventors of the present disclosure find that, in the related art, the structures of some partition skirts cause the hardness thereof to be too large, so that it is difficult for large-size dirt to fall into the dirt collection section, and the partition skirt tends to interfere with the components on the dust cup when the cyclone separation unit is removed and mounted, thereby causing the cyclone separation unit to be difficult to detach.

The structures of some partition skirts cause the hardness thereof to be too small, so that it is difficult to achieve the effective separation function.

Figure 1:
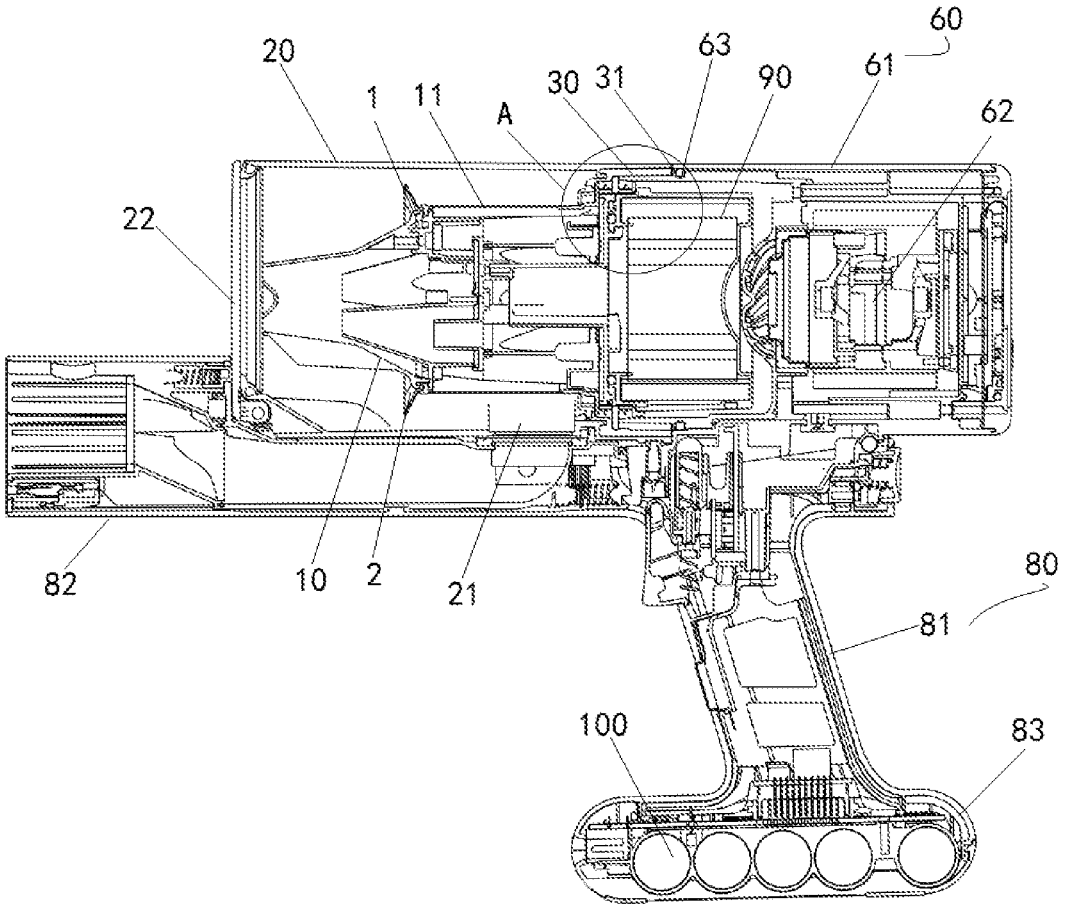
FIG. 1 is a sectional view of a cleaning apparatus of the present disclosure.

In an aspect, as shown in FIG. 1, embodiments of the present disclosure propose a cleaning apparatus, and the cleaning apparatus includes a main body 80, a main machine 60 mounted on the main body 80, a dust cup 20, and a removable cyclone separation unit 10 arranged in the dust cup 20, and further includes a dust scraping device for the cleaning apparatus.

The dust cup 20 and the main machine 60 are arranged on the main body 80, the dust scraping device is fixedly mounted at the dust cup 20, and the dust scraping device is connected with the main machine 60 through an engaging structure.

The main machine 60 includes a main-machine shell 61 and a fan 62 mounted in the main-machine shell 61.

A cylindrical connecting end extends outwards from a lower end surface of the main-machine shell 61, and three engaging blocks 63 are integrally formed outside the connecting end at equal intervals and are configured to be fitted, engaged and fixed in engaging grooves 310 formed in the dust scraping device on the dust cup 20. The arrangement of the engaging blocks 63 and the engaging grooves 310 allow the dust cup 20 and the main machine 60 to be quickly mounted, which is convenient for disassembling.

The fan 62 is electrically connected with a main control circuit inside the main body 80 for suction of outside air.

First Embodiment

Figure 2:
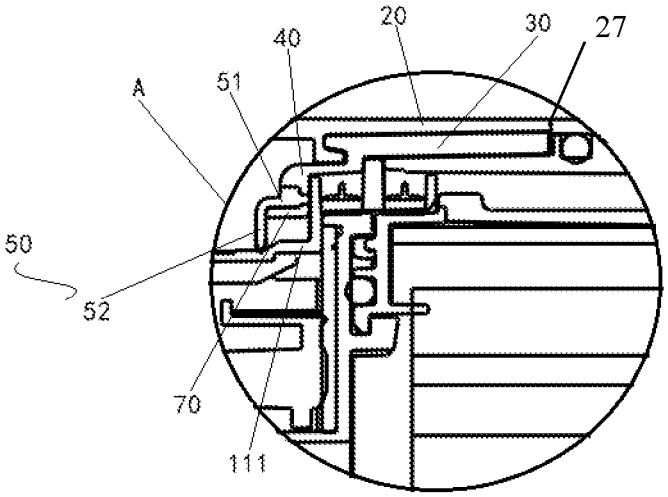
FIG. 2 is an enlarged view of portion "A" circled in FIG. 1.
Figure 3:
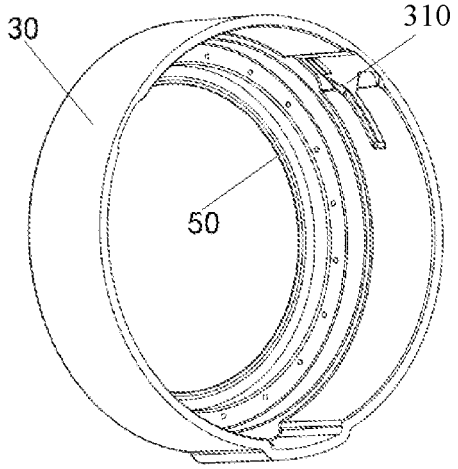
FIG. 3 is a perspective view of a dust scraping device of the present disclosure.

As shown in FIGS. 2 and 3, the dust scraping device includes a dust scraping member, and the dust scraping member has a connecting part extending along a removal direction of the cyclone separation unit 10 and a dust scraping part extending perpendicular to the removal direction into the dust cup 20 and slidably abutting against the cyclone separation unit 10.

The dust cup 20 has a cylindrical dust cup body and an opening part 27 arranged at an end of the dust cup body. The dust scraping member is a cylindrical dust scraping ring 50, and the dust scraping ring 50 is coaxially mounted at the opening part 27 of the dust cup 20.

The cyclone separation unit 10 is coaxially arranged in the dust cup 20. The cyclone separation unit 10 includes a cylindrical filter screen 11 and a cyclone separation part located downstream of the filter screen 11. The dust scraping ring 50 can scrape off the particulates outside the filter screen 11 so that the particulates may fall into the dust cup 20.

The main body 80 is formed as a gun-type structure, and the main body 80 includes a first transverse connecting part 82 extending substantially transversely and a hand-held part 81 extending substantially longitudinally. A fluid channel extending substantially transversely is arranged inside the first transverse connecting part 82. One end of the fluid channel is an air inlet, and the other end thereof is connected to a dust-cup air inlet 21 of the dust cup 20. The dusty airflow enters from the air inlet of the fluid channel of the first transverse connecting part 82, and then enters the dust cup 20 through the dust-cup air inlet 21, and the air is separated from the dust by the cyclone separation unit 10 coaxially arranged in the dust cup 20. As shown in FIG. 1, a first cyclone separation stage is formed between the filter screen 11 and an inner wall of the dust cup 20. The first cyclone separation stage can perform the preliminary dust and gas separation on the dusty airflow. A partition skirt device is arranged at a left end of the filter screen 11 away from the opening part 27. The partition skirt device partitions a chamber inside the dust cup 20 into a cyclone separation section, i.e., the first cyclone separation stage, and a dirt collection section.

Specifically, the dusty airflow entering the dust cup 20 first has a first cyclone separation around a periphery of the filter screen 11, the first cyclone separation stage is formed between the filter screen 11 and the dust cup 20, and the dirt separated by the first cyclone separation stage is collected in a first dirt collection region. Then, the air separated by the first cyclone separation stage enters a plurality of cyclone cones inside the filter screen 11 through holes in the filter screen 11 for a second cyclone separation, and the plurality of cyclone cones inside the filter screen 11 form a second cyclone separation stage. The dirt separated by the second cyclone separation stage is discharged and collected through a dirt outlet of each cyclone cone. As shown FIG. 1, a second dirt collection region is located on a left side of the cyclone cone and configured to collect the dirt discharged by each cyclone cone. The air separated by the second cyclone separation stage is discharged to a downstream HEPA filter device through an air outlet of the cyclone cone, and finally is discharged to the outside.

It should be noted that the filter screen 11 is a perforated plate made of hard materials, such as a metal plate. The purpose of the hole is to facilitate the passage of the air separated by the first cyclone separation stage, and to allow the large dirt to be intercepted outside the filter screen 11, and the dusty airflow entering the filter screen 11 has the dust and gas separation through the second cyclone separation stage. The plurality of cyclone cones of the second cyclone separation stage are arranged in a ring shape, an accommodation space is formed between left ends of the plurality of cyclone cones, and the accommodation space is used to accommodate a certain amount of dirt in the second dirt collection region.

Specifically, through the structure of the plurality of cyclone cones arranged in the ring shape, the arrangement of the cyclone separation unit 10 fully utilizes the space, the cyclone separation unit 10 has a compact structure, and the cyclone separation unit 10 can be provided with more cyclones in a limited space, thereby improving the dust and gas separation efficiency of the cyclone separation unit 10.

Further, specifically, the hand-held part 81 is located between the first transverse connecting part 82 and a second transverse connecting part 83. A main control circuit is fixedly connected in the hand-held part 81, and the main control circuit is electrically connected with the fan 62 through a start switch, so as to control the start and stop of the fan 62.

A left end of the first transverse connecting part 82 is an air input pipe, and the dust cup 20 is detachably mounted to the first transverse connecting part 82.

A battery pack 100 is provided in the second transverse connecting part 83 and used to power the main control circuit in the hand-held part 81.

Second Embodiment

The dust scraping device includes a dust scraping member, and the dust scraping member has a connecting part extending along a removal direction of the cyclone separation unit 10 and a dust scraping part extending perpendicular to the removal direction into the dust cup 20 and slidably abutting against the cyclone separation unit 10.

The dust cup 20 has a cylindrical dust cup body and an opening part 27 arranged at an end of the dust cup body. The dust scraping member is a cylindrical dust scraping ring 50, and the dust scraping ring 50 is coaxially mounted at the opening part 27 of the dust cup 20.

A partition skirt device is fixedly mounted at a bottom of the cyclone separation unit 10. When the cyclone separation unit 10 is taken out of the dust cup 20, the dust scraping device is used to scrape off the particulates on a first surface of a skirt body 2 of the partition skirt device at the bottom of the cyclone separation unit 10 into the dust cup 20.

It should be noted that the space between the dust cup 20 and the cyclone separation unit 10 serves as a separation chamber. The partition skirt device divides the separation chamber of the dust cup 20 into a dirt collection section on a left side and a cyclone separation section on a right side. When a vacuum cleaner is used to clean a lower surface to be cleaned, such as a floor, a sofa and a bed, the dirt collection section is located on a lower side of the cyclone separation section along the direction of gravity, which helps the dust to be concentrated into the dirt collection section under the action of its own gravity.

Based on the above first embodiment and second embodiment, the side wall of the dust cup body has a dust-cup air inlet 21 communicated with the air input pipe. The dusty airflow sucked by the fan 62 enters from the air input pipe and enters the separation chamber through the dust-cup air inlet 21 to separate the dust and air. When the cleaning apparatus is used, usually in the direction of gravity, the dirt collection section is located on the lower side of the cyclone separation section, so the dirt separated by the separation chamber is accumulated in the dirt collection section due to the action of gravity. The air input pipe is arranged in the first transverse connecting part 82 of the main body 80 and communicated with the dust-cup air inlet 21, and a structure for spirally advancing the incoming dusty airflow is arranged in the cyclone separation unit 10. Specifically, the dusty airflow is changed from straight advancing to spiral advancing, which increases the centrifugal force and enhances the dust collection effect. The left end of the dust cup 20 is provided with a dust pouring opening and a dust-cup end cover 22 configured to close the dust pouring opening. The dust-cup end cover 22 is mounted to the dust cup body through a hinge, and the dust-cup end cover 22 is maintained in a closed position through an engaging element at a top end of the dust-cup end cover 22. Specifically, the dust-cup end cover 22 can rotate between the closed position and an open position. In the closed position, the dust-cup end cover 22 keeps the dirt in the dirt collection section; and in the open position, the dirt can be removed from the dirt collection section.

Further, a radial section of the dust scraping ring 50 has an "L" shape. A transverse part of the "L" shape is the connecting part, and a vertical part of the "L" shape is the dust scraping part. The "L" shape has a simple structure, is compact relative to the prior art, and occupies a small proportion of space, which minimizes the interference between the dust scraping ring 50 and other components on the cyclone separation unit 10. Of course, the radial section is not limited to the "L" shape, and may also have a "T" shape.

Further, the dust scraping ring 50 includes a mounting collar 51 and an annular dust scraping plate 52, and an outer wall of the mounting collar 51 is fixedly connected in the dust cup 20. The annular dust scraping plate 52 is the vertical dust scraping part of the "L" shape, is integrally formed with a side of the mounting collar 51 away from the opening part 27 of the dust cup 20, and extends radially inwards to abut against the filter screen 11. When the cyclone separation unit 10 is taken out of the dust cup 20, the filter screen 11 slides through the annular dust scraping plate 52 to scrape off the particulates.

Further, the annular dust scraping plate 52 has an initial position where an inner edge of the annular scraping plate 52 abuts against a base 111 of the filter screen 11. Thus, the annular dust scraping plate 52 scrapes the dust on the filter screen 11 from the base 111 of the filter screen 11, thereby ensuring that the dust scraping ring 50 can scrape the dust on the entire filter screen 11 and improving the dust scraping effect of the annular dust scraping plate 52.

Further, the dust scraping device further includes a connecting base 30 and a dust-scraping-ring mounting frame 40 which are coaxially arranged with the dust scraping ring 50. The connecting base 30 is fixed to the opening part 27 of the dust cup 20, the dust-scraping-ring mounting frame 40 is arranged in the connecting base 30, and a side of the dust-scraping-ring mounting frame 40 away from the opening part 27 is fixedly connected with the dust scraping ring 50. In some embodiments, the dust scraping ring 50 and the dust-scraping-ring mounting frame 40 are detachably connected to facilitate replacement of the dust scraping ring 50.

Specifically, a positioning protrusion is formed between the connecting base 30 and the dust-scraping-ring mounting frame 40. The positioning protrusion is used to define a circumferential position of the dust scraping ring 50 on the dust cup 20, and then the connecting base 30 is fixed with the dust cup 20 by glue bonding.

Further, based on the above technical solution, as shown in FIG. 2, the dust scraping device in this embodiment further includes a support gasket 70. The support gasket 70 is coaxially arranged in the mounting collar 51, an outer peripheral surface of the support gasket 70 abuts against an inner peripheral surface of the mounting collar 51, and an end of the support gasket 70 abuts against the annular dust scraping plate 52, so as to support the mounting collar 51 and the annular dust scraping plate 52, thereby improving the overall strength of the dust scraping ring 50 and improving the dust scraping effect. In addition, the main machine 60 and the dust cup 20 are coaxially connected through an engaging structure. The dust scraping device is arranged at the opening part 27 of the dust cup 20 connected to the main-machine shell 61.

Further, an annular positioning step for positioning the cyclone separation unit 10 is formed at the connection between an inner side wall of the connecting base 30 and the dust-scraping-ring mounting frame 40, and the cyclone separation unit 10 is provided with a matching step that is fitted with the annular positioning step. The cyclone separation unit 10 is mounted to be just engaged on the positioning step, so that the base 111 of the filter screen 11 abuts against the annular dust scraping plate 52, which facilitates the precise positioning and quick mounting of the cyclone separation unit 10.

Further, a sealing ring is arranged between the annular positioning step and the matching step, which improves the sealing performance of the connection between the cyclone separation unit 10 and the dust cup 20.

Further, the dust scraping ring 50 is made of rubber materials, for example, TPU materials. The deformability of the dust scraping ring 50 when moving relative to the cyclone separation unit 10 is improved, thereby facilitating the interference with components such as the partition skirt device in the cyclone separation unit 10.

Third Embodiment

Figure 4:
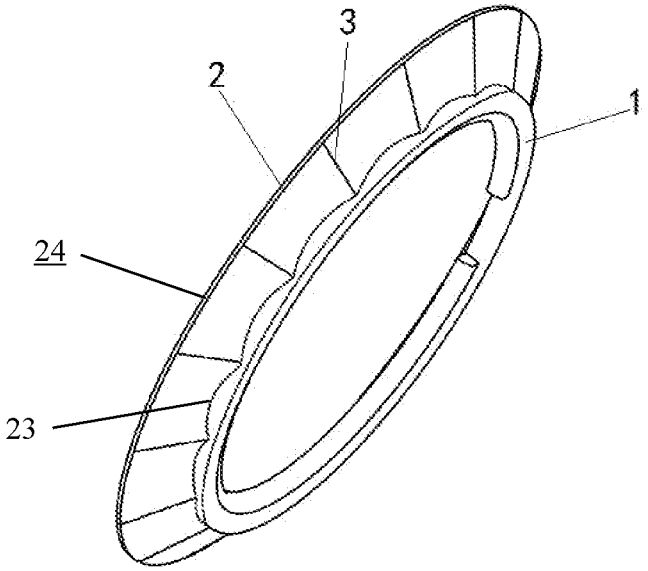
FIG. 4 is a perspective view of a partition skirt device of the present disclosure.
Figure 5:
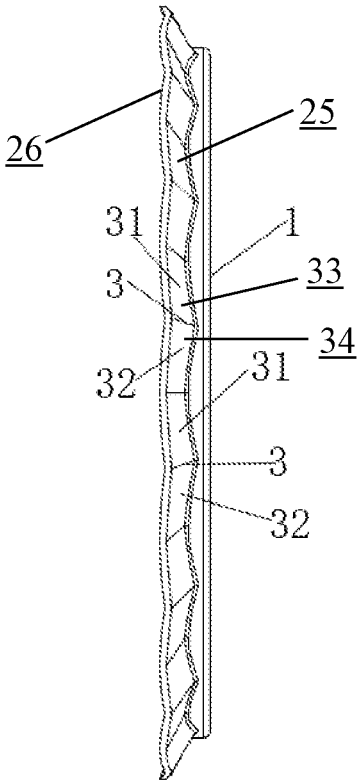
FIG. 5 is a left side view of a partition skirt device of the present disclosure, in which an outer ring of a skirt body is removed.
Figure 6:
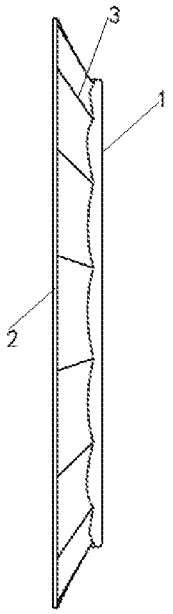
FIG. 6 is a left side view of a partition skirt device of the present disclosure, in which no parts are removed.

As shown in FIGS. 4-6, a partition skirt device is configured to be mounted on a cyclone separation unit of a cleaning apparatus. The partition skirt device has an annular structure. The partition skirt device includes an annular inner ring 1 and an annular skirt body 2.

The skirt body 2 has a root 23 connected to the inner ring 1, and an edge part 24 arranged at an end of the skirt body 2 away from the inner ring 1. The diameter of the edge part 24 is larger than the diameter of the root 23. The skirt body 2 further includes a plurality of collapsing parts 3 arranged at intervals between the root 23 and the edge part 24 along a circumferential direction of the skirt body 2, and the collapsing part 3 is configured as a long strip structure extending along a radial direction of the skirt body 2.

Along a thickness direction of the skirt body 2, the collapsing part 3 protrudes relative to the skirt body 2 on a first side surface 25 of the skirt body 2, and is recessed relative to the skirt body 2 on a second side surface 26 of the skirt body 2. Moreover, on the first side surface 25 of the skirt body 2, a size of a portion of the collapsing part 3 protruding from the skirt body 2 gradually decreases from the root 23 to the edge part 24.

The present disclosure provides the partition skirt device including the inner ring 1 and the skirt body 2. The plurality of collapsing parts 3 are formed on the skirt body 2, and the collapsing part 3 protrudes relative to the skirt body 2 on the first side surface 25 of the skirt body 2, and is recessed relative to the skirt body 2 on the second side surface 26 of the skirt body 2. In addition, on the first side surface 25 of the skirt body 2, the size of the portion of the collapsing part 3 protruding from the skirt body 2 gradually decreases from the root 23 to the edge part 24. Compared with the prior art, the partition skirt device has a separation function and also has a simple structure. Moreover, the collapsing parts 3 are reasonably arranged, and arc connecting parts formed between adjacent collapsing parts 3 are easy to deform to facilitate the passage of dirt, so that the structure of the entire partition skirt device is moderate in flexibility, does not tend to interfere with the components on the dust cup, and also can effectively separate the dirt. Thus, the dirt can smoothly enter the dirt collection section.

Further, on the second side surface 26 of the skirt body 2, a size of a portion of the collapsing part 3 recessed into the skirt body 2 gradually decreases from the root 23 to the edge part.

A size of the collapsing part 3 in the thickness direction of the skirt body 2 gradually decreases from the root 23 to the edge part 24, so as to ensure the effective separation of the dirt and to facilitate the dirt to enter the dirt collection section smoothly.

Further, as shown in FIG. 5, along the circumferential direction of the skirt body 2, a first arc connecting part 31 is formed on a first side 33 of the collapsing part 3, and a second arc connecting part 32 is formed on a second side 34 of the collapsing part 3. The second arc connecting part 32 of one collapsing part 3 is connected with the first arc connecting part 31 of another adjacent collapsing part 3. The arc connecting parts are formed between adjacent collapsing parts 3 on the first side surface 25 of the skirt body 2, thereby providing a beautiful appearance.

It should be noted that the first side surface 25 of the skirt body 2 is defined as a surface where the first arc connecting part 31 and the second arc connecting part 32 are connected.

Further, other arc connecting parts are formed between adjacent collapsing parts 3 on the second side surface 26 of the skirt body 2.

Figure 7:
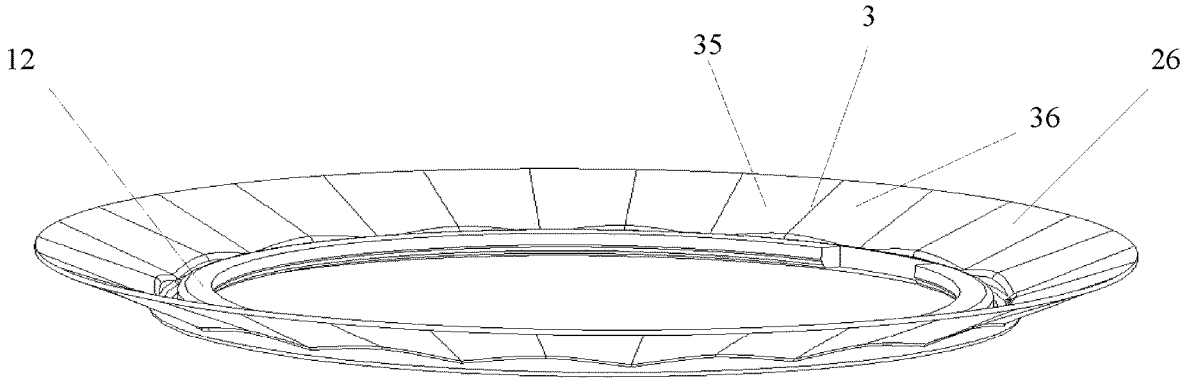
FIG. 7 is a perspective view of a partition skirt device of the present disclosure.
Figure 8:
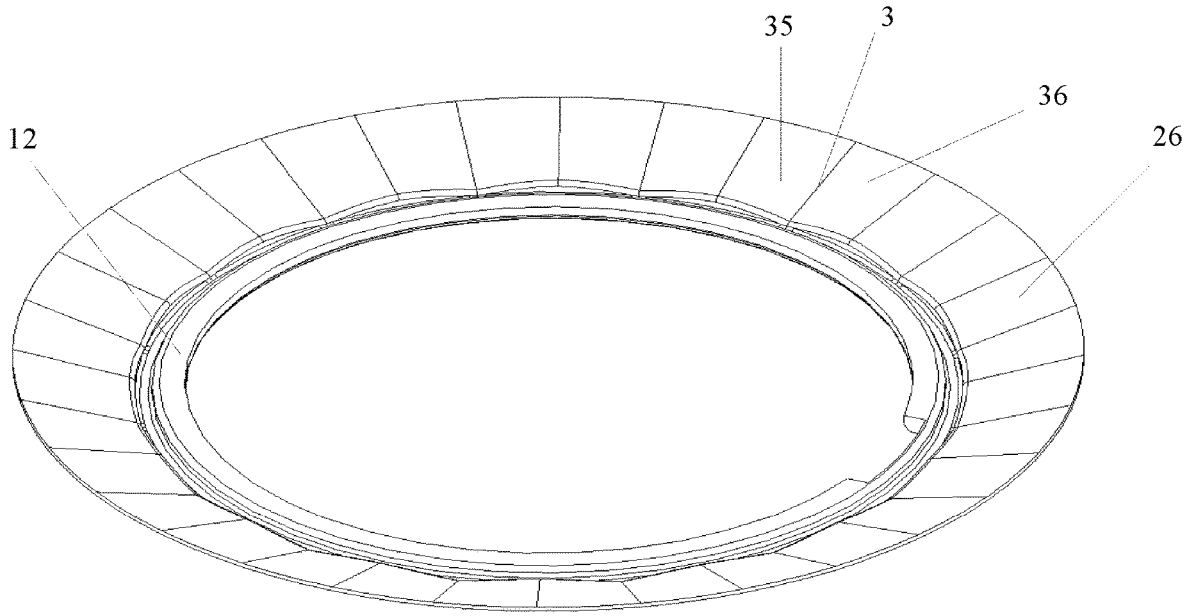
FIG. 8 is a perspective view of a partition skirt device of the present disclosure.

Further, as shown in FIGS. 7 and 8, along the circumferential direction of the skirt body 2, a third arc connecting part 35 is formed on a first side 33 of the collapsing part 3, and a fourth arc connecting part 36 is formed on a second side 34 of the collapsing part 3. The fourth arc connecting part 36 of one collapsing part 3 is connected with the third arc connecting part 35 of another adjacent collapsing part 3.

Further, on the first side surface 25 of the skirt body 2, the size of the portion of the collapsing part 3 protruding from the skirt body 2 gradually decreases from the root 23 to the edge part 24 until disappears, and on the second side surface 26 of the skirt body 2, the size of the portion of the collapsing part 3 recessed into the skirt body 2 gradually decreases from the root 23 to the edge part 24 until disappears, so as to smooth the edge part 24.

The inner ring 1 is an annular structural member, and an inner side wall of the inner ring 1 has an engaging part 12 configured to be connected with the cyclone separation unit 10, as shown in FIGS. 7-10. The engaging part 12 facilitates the assembling and disassembling of the inner ring 1 and the cyclone separation unit 10. An outer side wall of the inner ring 1 is formed integrally with the root in the circumferential direction. The outer side wall of the inner ring 1 and the root 23 of the skirt body 2 form a wave shape in the circumferential direction. An annular engaging groove is formed in a left end surface of the inner ring 1, and the annular engaging groove is configured to be assembled with the bottom of the cyclone separation unit 10.

Further, the material of the partition skirt device is silica gel. The silica gel has a good deformation effect, which facilitates the smooth passage of the dirt.

The partition skirt device is angled towards an outer wall of the dust cup 20 and extends away from a central axis.

The dust cup 20 includes a cylindrical body. Along an axial direction of the cylindrical body, a dust-cup end cover 22 is arranged at an end of the cylindrical body, and the opening part 27 is arranged on another end of the cylindrical body. The partition skirt device is located in middle of the cylindrical body. The dirt collection section is formed between the dust-cup end cover 22 and the partition skirt device, the cyclone separation section is formed between the opening part 27 and the partition skirt device, and the skirt body extends obliquely towards the dirt collection section.

Further, the skirt body 2 is made of an elastically deformable material.

Figure 9:
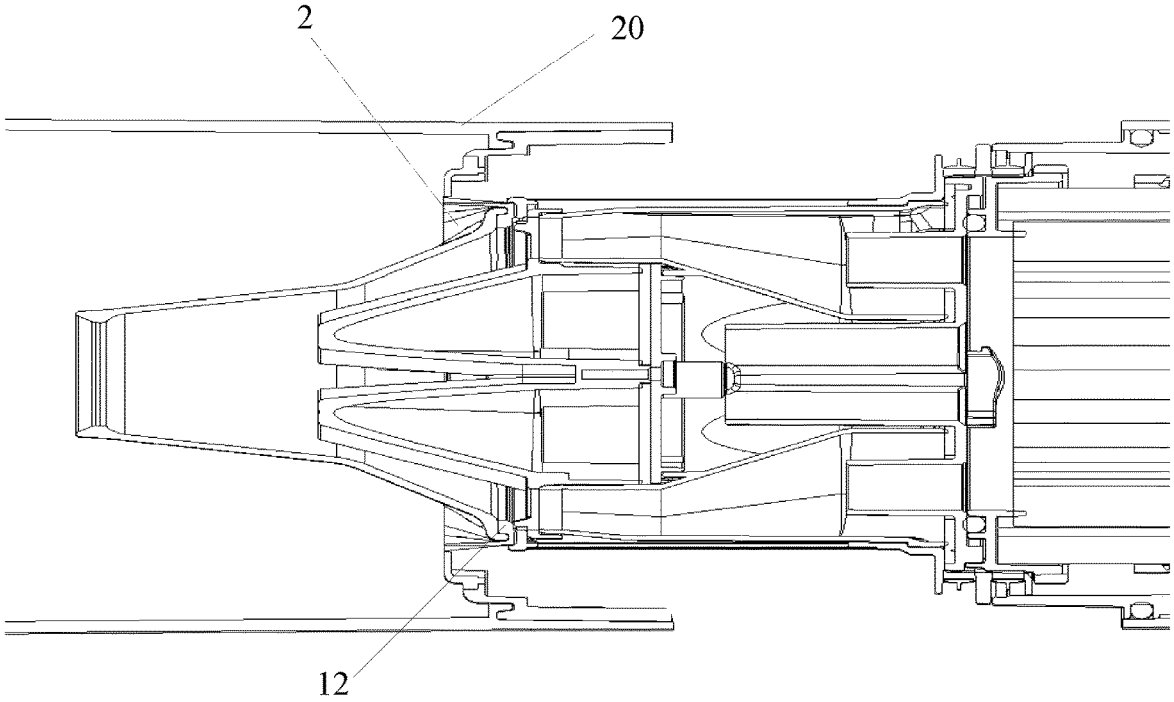
FIG. 9 is a schematic view illustrating a skirt body in a first position of the present disclosure.

The skirt body 2 is compressed and deformed towards the central axis and away from the opening part 27 of the dust cup 20, so that the skirt body 2 is in a first position, as shown in FIG. 9.

Figure 10:
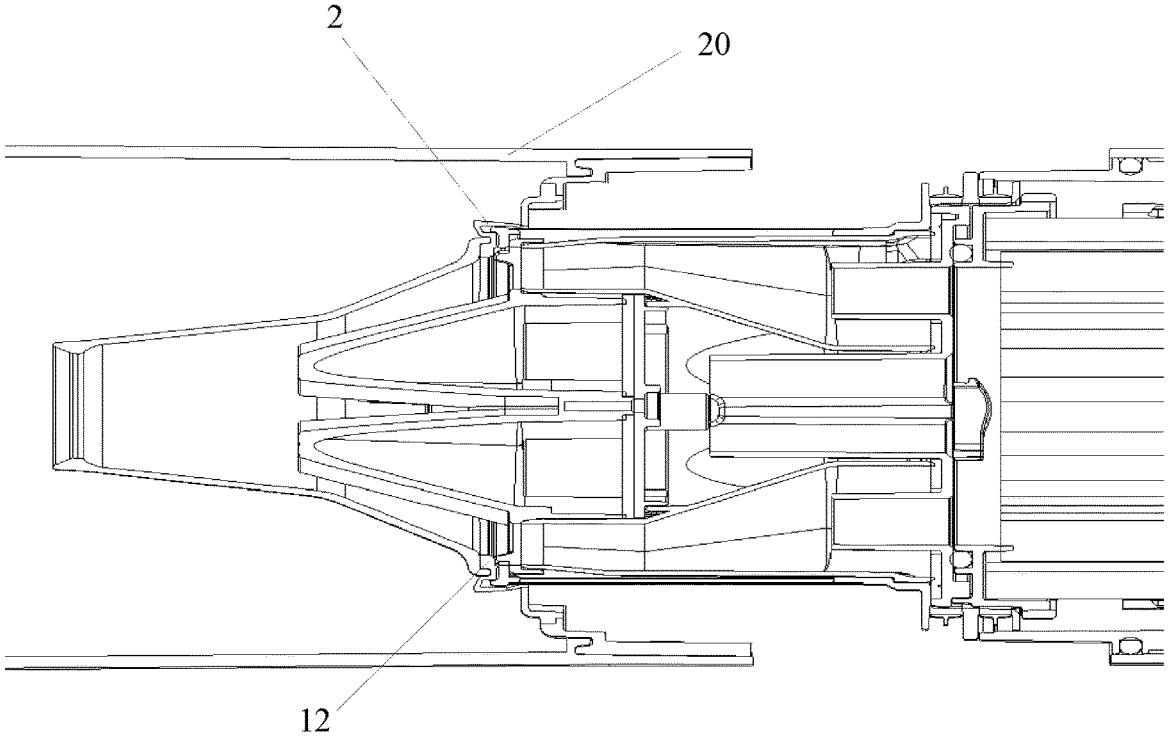
FIG. 10 is a schematic view illustrating a skirt body in a second position of the present disclosure.

The skirt body 2 is compressed and deformed along a direction opposite to the first position so that the skirt body 2 is in a second position, as shown in FIG. 10. The skirt body 2 is deformed between the first position and the second position.

Specifically, during the process of taking the cyclone separation unit out of the dust cup 20, when the skirt body 2 passes through the dust scraping device, the skirt body is pressed, then shrinks and deforms in a direction opposite to a direction in which the cyclone separation unit is taken out, and is creased at the collapsing parts 3 (similar to a state when an umbrella is folded), so that the skirt body 2 is in the first position. After passing through the dust scraping device, the skirt body 2 automatically returns to an unfolded state under the action of its own elastic restoring force. In the process of mounting the cyclone separation unit into the dust cup 20, when the skirt body 2 passes through the dust scraping device, the skirt body is pressed, and deforms in a direction opposite to a direction in which the cyclone separation unit is mounted, so that the skirt body 2 is in the second position. After passing through the dust scraping device, the skirt body 2 returns to the unfolded state under the action of its own elastic restoring force.

The partition skirt device has a specific working mode as follow.

In a first situation, when large dirt passes from the cyclone separation section to the dirt collection section, a force applied to the skirt body 2 by the dirt can deform the arc connecting parts formed between the adjacent collapsing parts 3 of the skirt body 2. Therefore, a portion of the skirt body 2 on which the force is acted will be deformed to allow the dirt to pass smoothly.

In a second situation, when the cyclone separation unit 10 is detached, it is specifically judged whether the skirt body 2 needs to be folded according to the size of a removal opening for the cyclone separation unit 10, i.e. the opening part 27 of the dust cup 20.

The skirt body 2 fixed on the cyclone separation unit 10 interferes with the dust scraping device on the dust cup 20 when passing therethrough, so that the arc connecting parts formed between the adjacent collapsing parts are deformed and folded under forces.

If the size of the removal opening for the cyclone separation unit 10, i.e. the opening part 27 of the dust cup 20, is large enough, the skirt body 2 is directly taken out without being folded.

Further, the cleaning apparatus further includes an integrated filter element 90 which is arranged at an outlet end of the cyclone cone and configured to filter the air separated by the second cyclone separation stage again. The integrated filter element 90 is detachably arranged in the cyclone separation unit 10 to facilitate the replacement of the integrated filter element 90. Moreover, the integrated filter element 90 further filters the air separated by the second separation unit, so that fewer air impurities are discharged to the outside and the dust collection effect is better.

It should be noted that although the first embodiment, the second embodiment and the third embodiment of the present disclosure are described separately, they can be combined with one another according to specific applications.

In the description of the present disclosure, it should be understood that the terms "first" and "second" are only used for the purpose of description, rather than being understood to indicate or imply relative importance or to hint the number of indicated technical features. Thus, the feature limited by "first" and "second" can explicitly or impliedly include one or more features. In the description of the present disclosure, "a plurality of" means two or more, unless otherwise clearly specified.

In the present disclosure, unless otherwise specifically regulated and defined, terms such as "mount", "interconnect", "connect", "fix" or the like shall be understood in broad sense, and for example, may refer to fixed connection or detachable connection or integral connection, may refer to mechanical connection or electrical connection, may refer to direct connection or indirect connection through an intermediate medium, and may refer to inner communication of two elements or interaction relationship of two elements. For those ordinary skilled in the art, the specific meanings of the above terms in the present disclosure may be understood according to concrete conditions.

In the present disclosure, unless otherwise clearly specified and defined, a first feature is "above" or "below" a second feature may indicate that the first feature and the second feature are in a direction contact or in an indirect contact through an intermediate medium. Moreover, the first feature is "on", "above" and "over" the second feature may be that the first feature is directly above or obliquely above the second feature, or just indicates that the level of the first feature is higher than that of the second feature. The first feature is "under", "below" and "beneath" the second feature may be that the first feature is directly below or obliquely below the second feature, or just indicates that the level of the first feature is lower than that of the second feature.

In the description of this specification, the description of terms "an embodiment", "some embodiments", "embodiment", "example", "specific example" or "some examples", etc. means that specific features, structures, materials or characteristics illustrated in combination with the embodiment or example are included in at least one embodiment or example of the present disclosure. In this specification, exemplary expressions for the above terms do not must aim at the same embodiment or example. Moreover, the described specific features, structures, materials or characteristics can be combined appropriately in any one or more embodiments or examples. In addition, without contradiction, those skilled in the art can combine and integrate different embodiments or examples and features of different embodiments or examples described in this specification.

Although the embodiments of the present disclosure have been shown and described above, it will be appreciated that the above embodiments are exemplary and shall not be understood as limitations to the present disclosure. Those ordinary skilled in the art can make changes, amendments, replacements and variations to the above embodiments within the scope of the present disclosure.

What is claimed is:

1. A partition skirt device, configured to be mounted in a cyclone separation unit of a cleaning apparatus, the partition skirt device having an annular structure, wherein the partition skirt device comprises: an annular inner ring; and an annular skirt body comprising: a root connected to the inner ring; an edge part arranged at an end of the skirt body away from the inner ring, a diameter of the edge part being larger than a diameter of the root; and a plurality of collapsing parts arranged at intervals between the root and the edge part along a circumferential direction of the skirt body, and the collapsing part being configured as a long strip structure extending along a radial direction of the skirt body, wherein along a thickness direction of the skirt body, the collapsing part protrudes relative to the skirt body on a first side surface of the skirt body, and is recessed relative to the skirt body on a second side an annular skirt body comprising:

a root connected to the inner ring;

an edge part arranged at an end of the skirt body away from the inner ring, a diameter of the edge part being larger than a diameter of the root; and a plurality of collapsing parts arranged at intervals between the root and the edge part along a circumferential direction of the skirt body, and the collapsing part being configured as a long strip structure extending along a radial direction of the skirt body, wherein along a thickness direction of the skirt body, the collapsing part protrudes relative to the skirt body on a first side surface of the skirt body, and is recessed relative to the skirt body on a second side surface of the skirt body;

on the first side surface of the skirt body, a size of a portion of the collapsing part protruding in the thickness direction from the skirt body gradually decreases from the root to the edge part.

2. The partition skirt device of claim 1, wherein on the second side surface of the skirt body, a height size of a portion of the collapsing part recessed into the skirt body gradually decreases from the root to the edge part.

3. The partition skirt device of claim 1, wherein a height size of the collapsing part along the thickness direction of the skirt body gradually decreases from the root to the edge part.

4. The partition skirt device of claim 1, wherein an arc connecting part is arranged between adjacent collapsing parts on the first side surface of the skirt body.

5. The partition skirt device of claim 4, wherein along the circumferential direction of the skirt body, a first arc connecting part is arranged on a first side of the collapsing part, and a second arc connecting part is arranged on a second side of the collapsing part, wherein the second arc connecting part of one collapsing part is connected with the first arc connecting part of another adjacent collapsing part.

6. The partition skirt device of claim 1, wherein another arc connecting part is arranged between adjacent collapsing parts on the second side surface of the skirt body.

7. The partition skirt device of claim 6, wherein along the circumferential direction of the skirt body, a third arc connecting part is arranged on a first side of the collapsing part, and a fourth arc connecting part is arranged on a second side of the collapsing part, wherein the fourth arc connecting part of one collapsing part is connected with the third arc connecting part of another adjacent collapsing part.

8. The partition skirt device of claim 1, wherein on the second side surface of the skirt body, a height size of a portion of the collapsing part recessed into the skirt body gradually decreases from the root to the edge part until disappearing, so as to smooth the edge part.

9. The partition skirt device of claim 1, wherein the inner ring is an annular structural member, and an inner side wall of the inner ring has an annular engaging protrusion configured to be connected with the cyclone separation unit.

10. A cleaning apparatus, comprising:

a gun-type main body;

a main machine mounted on the main body;

a dust cup arranged on the main body and having an opening part connected with the main machine through an engaging structure;

a removable cyclone separation unit arranged in the dust cup; and a partition skirt device connected with the cyclone separation unit, and comprising:

an annular inner ring connected with the cyclone separation unit; and an annular skirt body comprising:

a root connected to the inner ring;

an edge part arranged at an end of the skirt body away from the inner ring, a diameter of the edge part being larger than a diameter of the root; and a plurality of collapsing parts arranged at intervals between the root and the edge part along a circumferential direction of the skirt body, and the collapsing part being configured as a long strip structure extending along a radial direction of the skirt body, wherein along a thickness direction of the skirt body, the collapsing part protrudes relative to the skirt body on a first side surface of the skirt body, and is recessed relative to the skirt body on a second side surface of the skirt body;

on the first side surface of the skirt body, a height size of a portion of the collapsing part protruding from the skirt body gradually decreases from the root to the edge part until disappearing.

11. The cleaning apparatus of claim 10, wherein the partition skirt device is angled towards an outer wall of the dust cup and extends away from a central axis.

12. The cleaning apparatus of claim 10, wherein the dust cup comprises a cylindrical body; along an axial direction of the cylindrical body, a dust-cup end cover is arranged at one end of the cylindrical body, and the opening part is arranged on the other end of the cylindrical body; the partition skirt device is located in middle of the cylindrical body, wherein a dirt collection section is formed between the dust-cup end cover and the partition skirt device, a cyclone separation section is formed between the opening part and the partition skirt device, and the skirt body extends obliquely towards the dirt collection section.

13. The cleaning apparatus of claim 10, wherein the skirt body is made of an elastically deformable material;

the skirt body is configured to be compressed and deformed towards the central axis and away from the opening part of the dust cup, so as to be in a first position;

the skirt body is configured to be compressed and deformed in a direction opposite to the first position, so as to be in a second position, and the skirt body is configured to be deformed between the first position and the second position.

14. The cleaning apparatus of claim 10, wherein on the second side surface of the skirt body, a size of a portion of the collapsing part in the thickness direction recessed into the skirt body gradually decreases from the root to the edge part.

15. The cleaning apparatus of claim 10, wherein an arc connecting part is arranged between adjacent collapsing parts on the first side surface of the skirt body.

16. The cleaning apparatus of claim 15, wherein along the circumferential direction of the skirt body, a first arc connecting part is arranged on a first side of the collapsing part, and a second arc connecting part is arranged on a second side of the collapsing part, wherein the second arc connecting part of one collapsing part is connected with the first arc connecting part of another adjacent collapsing part.

17. The cleaning apparatus of claim 10, wherein another arc connecting part is arranged between adjacent collapsing parts on the second side surface of the skirt body.

18. The cleaning apparatus of claim 17, wherein along the circumferential direction of the skirt body, a third arc connecting part is arranged on a first side of the collapsing part, and a fourth arc connecting part is arranged on a second side of the collapsing part, wherein the fourth arc connecting part of one collapsing part is connected with the third arc connecting part of another adjacent collapsing part.

19. The cleaning apparatus of claim 10, wherein on the second side surface of the skirt body, a size of a portion of the collapsing part in the thickness direction recessed into the skirt body gradually decreases from the root to the edge part, so as to smooth the edge part.

20. The cleaning apparatus of claim 10, wherein the inner ring is an annular structural member, and an inner side wall of the inner ring has an annular engaging protrusion configured to be connected with the cyclone separation unit.

* * * * *